US011119426B2

(12) United States Patent
Murakawa et al.

(10) Patent No.: US 11,119,426 B2
(45) Date of Patent: Sep. 14, 2021

(54) DEVELOPING ROLLER, DEVELOPER, AND IMAGE FORMING APPARATUS

(71) Applicant: Konica Minolta, Inc., Tokyo (JP)

(72) Inventors: Junji Murakawa, Toyokawa (JP); Takeru Kinoshita, Toyokawa (JP); Hideaki Ikeda, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 16/987,697

(22) Filed: Aug. 7, 2020

(65) Prior Publication Data

US 2021/0063915 A1 Mar. 4, 2021

(30) Foreign Application Priority Data

Aug. 30, 2019 (JP) ..... JP2019-158214

(51) Int. Cl.
*G03G 15/09* (2006.01)

(52) U.S. Cl.
CPC ..... *G03G 15/0935* (2013.01); *G03G 15/0928* (2013.01)

(58) Field of Classification Search
CPC ..... G03G 15/0928; G03G 15/0921; G03G 15/0935; G03G 15/0818
See application file for complete search history.

(56) References Cited

U.S. PATENT DOCUMENTS 5,768,658 A * 6/1998 Watanabe ..... G03G 15/0935 399/111
5,842,962 A * 12/1998 Yamada ..... B23P 11/025 492/18
2007/0110481 A1* 5/2007 Yamada ..... G03G 15/0818 399/279
2016/0266520 A1* 9/2016 Iketani ..... G03G 15/0812

FOREIGN PATENT DOCUMENTS

JP H11-176631 A 7/1999

* cited by examiner

*Primary Examiner* — Walter L Lindsay, Jr.
*Assistant Examiner* — Jessica L Eley
(74) *Attorney, Agent, or Firm* — Osha Bergman Watanabe & Burton LLP

(57) ABSTRACT

A developing roller includes: a magnet roller including a roll part with a magnetic pole; a cylindrical sleeve that houses the magnet roller; a first flange connected to one end of the sleeve; a second flange connected to another end of the sleeve; a conductive shaft connected to a side of the second flange of the magnet roller; a first bearing that supports the first flange so that the first flange rotates relative to the magnet roller; and second bearings that support the second flange so that the second flange rotates relative to the conductive shaft. The second bearings are conductive, and are disposed at different positions along an axial direction of the conductive shaft.

10 Claims, 10 Drawing Sheets

DEVELOPING ROLLER, DEVELOPER, AND IMAGE FORMING APPARATUS

The entire disclosure of Japanese patent Application No. 2019-158214, filed on Aug. 30, 2019, is incorporated herein by reference.

BACKGROUND

Technological Field

The present invention relates to a developing roller, a developer, and an image forming apparatus.

Description of the Related Art

An electrophotographic image forming apparatus is known. The image forming apparatus includes a developing roller. The developing roller has structure in which a magnet roller is disposed inside a cylindrical sleeve. The magnet roller includes a roll part and a shaft part. The roll part has magnetic poles.

Magnet rollers having the configuration in which a magnet is formed so as to surround a metal through shaft or the configuration in which a magnet is attached around the metal through shaft have been traditionally used. In order to provide more inexpensive configuration, JP H11-176631 A discloses a magnet roller integrally formed of resin magnet material. The magnet roller includes a roll part and a shaft part. The shaft parts at both ends of such a magnet roller are formed of resin magnet material.

In order for a developing roller to perform developing operation, a developing bias needs to be applied to the surface of a sleeve. In the case of a magnet roller using a metal through shaft, the sleeve can be conducted by applying voltage to a through shaft and using bearings pressed into flanges on the front and back sides in an axial direction. In the case, two conduction paths are used.

As illustrated in the second embodiment of JP H11-176631 A, a magnet roller in which a metal through shaft is abolished can have the configuration in which conduction is performed by pressing a metal shaft into one end of a roll part formed of resin magnet material and using the metal shaft. In the case, a conduction path is provided on one side in the axial direction.

A regulation blade and developer are disposed around a sleeve of a developer. Since the regulation blade and the developer are made of magnetic materials, the regulation blade and the developer cause bending of the magnet roller. A bending amount is particularly large in the configuration without the metal through shaft. In a developing roller having a conduction path only on one side in the axial direction, contact resistance between a bearing and a metal shaft locally changes at the time of rotation to cause conduction failure at the time of occurrence of the bending. Unfortunately, this results in periodic unevenness of density on an image.

SUMMARY

One or more embodiments of the present invention provide a developing roller, a developer, and an image forming apparatus capable of inhibiting conduction failure caused by local change in contact resistance between a bearing and a metal shaft at the time of rotation and capable of inhibiting influence on an image even when bending of a magnet roller occurs.

According to one or more embodiments of the present invention, a developing roller comprises: a magnet roller including a roll part having a magnetic pole; a sleeve that has a cylindrical shape and houses the magnet roller inside the sleeve itself; a first flange connected to one end of the sleeve; a second flange connected to another end of the sleeve; a conductive shaft connected to a side of the second flange of the magnet roller; a first bearing that supports the first flange so that the first flange is allowed to rotate relative to the magnet roller; and a plurality of second bearings that supports the second flange so that the second flange is allowed to rotate relative to the conductive shaft, in which the plurality of second bearings has conductivity, and is disposed at different positions along an axial direction of the conductive shaft.

BRIEF DESCRIPTION OF THE DRAWINGS

The advantages and features provided by one or more embodiments of the present invention will become more fully understood from the detailed description given hereinbelow and the appended drawings which are given by way of illustration only, and thus are not intended as a definition of the limits of the present invention.

DETAILED DESCRIPTION

Hereinafter, one or more embodiments of the present invention will be described with reference to the drawings. However, the scope of the invention is not limited to the disclosed embodiments.

First Embodiment (Configuration)

An image forming apparatus according to a first embodiment of the invention will be described with reference to FIGS. 1 to 10.

Figure 1:
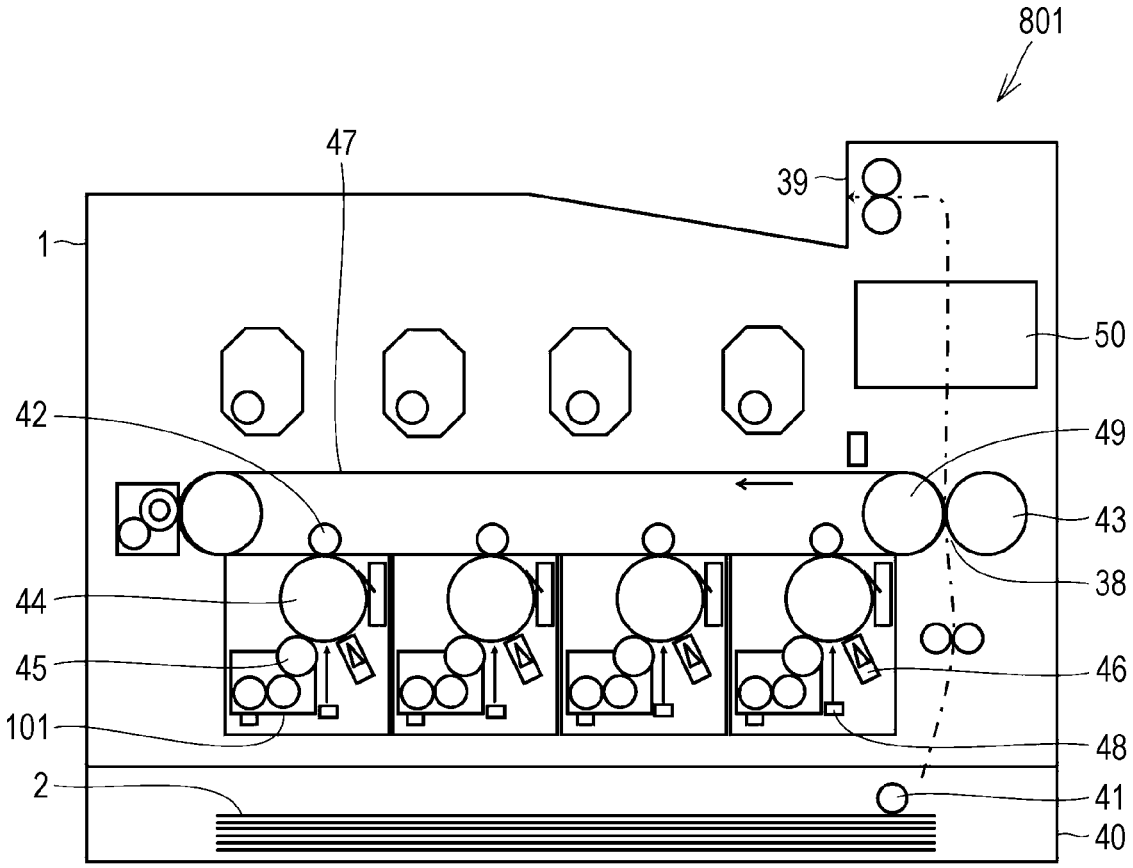
FIG. 1 is a conceptual diagram of an image forming apparatus according to a first embodiment of the invention.

FIG. 1 is a conceptual diagram of an image forming apparatus 801 in this embodiment. The image forming apparatus 801 includes a casing 1 and a cassette 40 disposed under the casing 1. For example, a photoreceptor 44, a charger 46, a transfer belt 47, an image exposure device 48, a developer 101, a primary transfer roller 42, a secondary transfer roller 43, and a fixing device 50 are disposed inside the casing 1. The developer 101 includes a developing roller 45. One or more recording media 2 are stored in the cassette 40. The recording medium 2 may be, for example, paper, or may be other than paper. The transfer belt 47 is endless, and is disposed so as to circularly travel.

In the image forming apparatus 801, the charger 46 charges the surface of the photoreceptor 44 such that the surface uniformly has a predetermined potential. The image exposure device 48 performs image exposure on the charged area in accordance with an original image. This causes an electrostatic latent image to be formed on the surface of the photoreceptor 44. The electrostatic latent image is developed by the developing roller 45, to which a developing bias is applied, to be a visible toner image. A bias that attracts toner is applied to the primary transfer roller 42. The visible toner image on the surface of the photoreceptor 44 is transferred to the transfer belt 47.

In contrast, the recording media 2 are taken out one by one from the cassette 40 by a paper feeding roller 41, and are conveyed to the secondary transfer roller 43. A voltage is applied to the secondary transfer roller 43 as well as the primary transfer roller 42. The transfer belt 47 is sandwiched between the secondary transfer roller 43 and a pressing roller 49. This portion constitutes a secondary transfer nip portion 38. When the recording medium 2 passes through the secondary transfer nip portion 38, the recording medium 2 and the transfer belt 47 are sandwiched and pressed by the secondary transfer roller 43 and the pressing roller 49. The visible toner image conveyed by the transfer belt 47 is transferred to the recording medium 2 at the secondary transfer nip portion 38. The recording medium 2 carrying the visible toner image is sent to the fixing device 50. The fixing device 50 performs heating and pressurization. Toner is fixed on the recording medium 2. The recording medium 2 on which image formation is completed in this way is discharged from an outlet 39.

Figure 2:
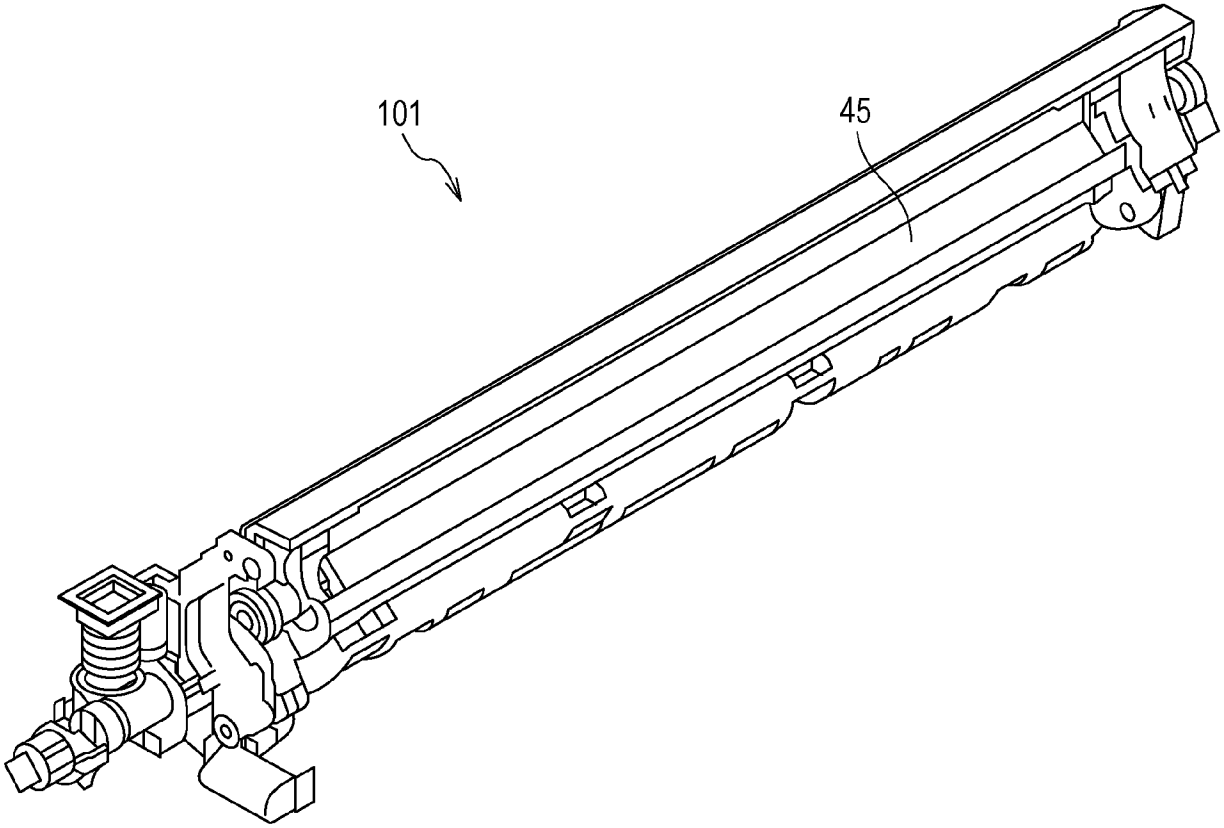
FIG. 2 is a perspective view of a developer of the image forming apparatus according to the first embodiment of the invention.
Figure 3:
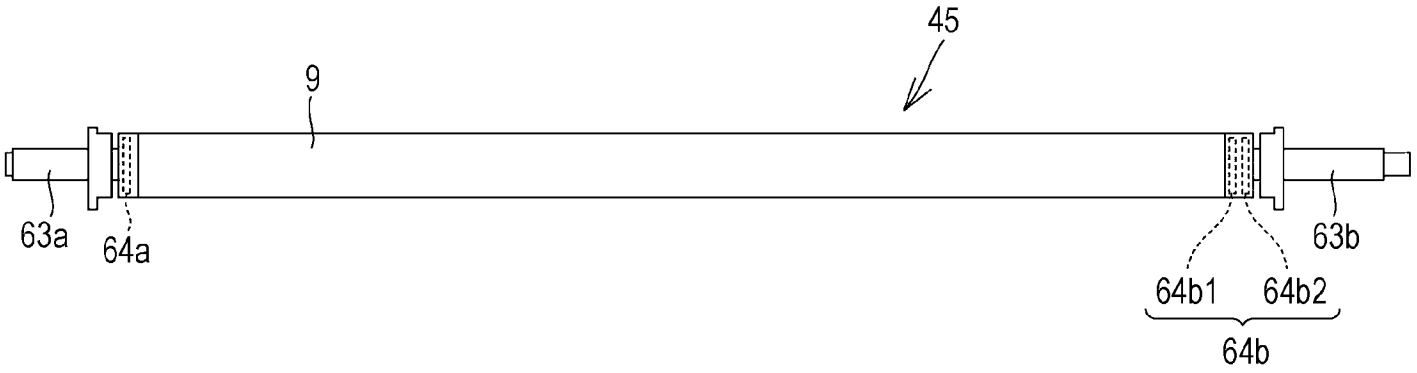
FIG. 3 is a front view of a developing roller of the image forming apparatus according to the first embodiment of the invention.

FIG. 2 illustrates the developer 101, which is detached. In the developer 101, the outer peripheral surface of the developing roller 45 is partially exposed. FIG. 3 illustrates only the developing roller 45, which is detached. Shaft parts 63*a* and 63*b* extend at both ends of a sleeve 9. A bearing 64*a* holds the shaft part 63*a*. A bearing group 64*b* holds the shaft part 63*b*. The bearing group 64*b* includes bearings 64*b*1 and 64*b*2. The bearing 64*a* and the bearing group 64*b* serve to rotate the developing roller 45 in the developer 101.

Figure 4:
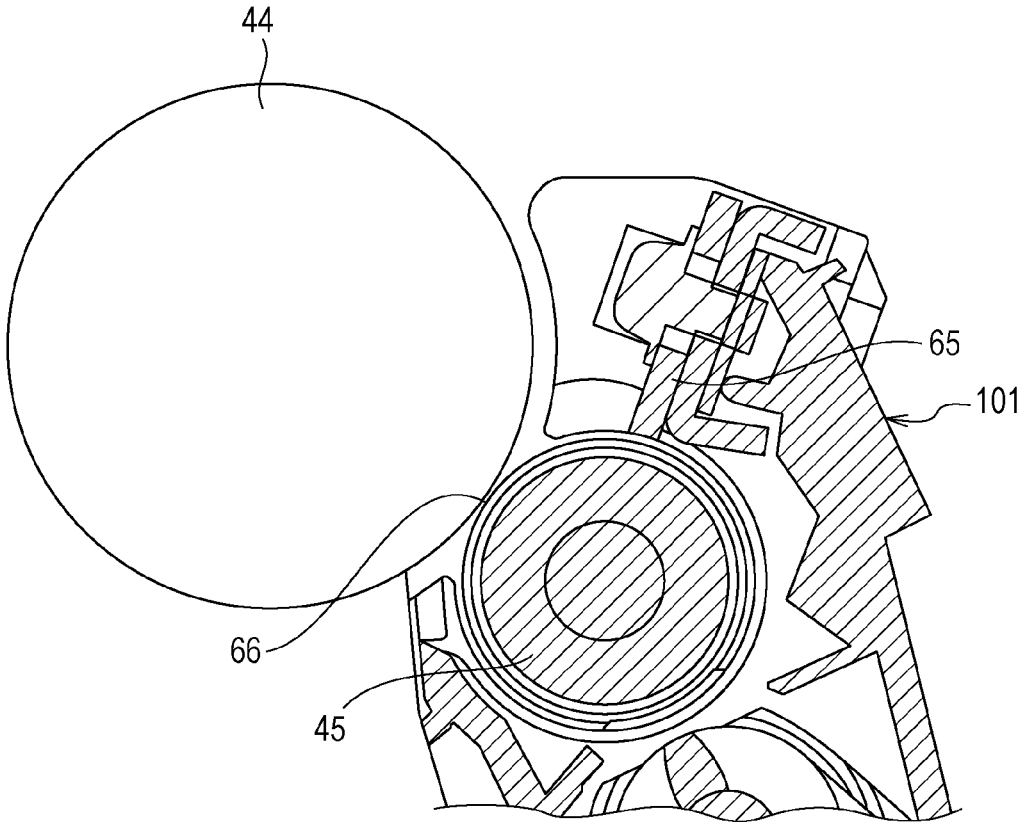
FIG. 4 is an explanatory view of the positional relation between the developer and a photoreceptor of the image forming apparatus according to the first embodiment of the invention.

FIG. 4 illustrates a combination of the developer 101 and the photoreceptor 44.

Developer in the developer 101 is adsorbed on the surface of the developing roller 45. As the developing roller 45 rotates, the developer is conveyed along the outer peripheral surface of the developing roller 45. A regulation blade 65 is attached to the developer 101. An end of the regulation blade 65 is in proximity to the outer peripheral surface of the developing roller 45. The regulation blade 65 rubs and uniformizes the developer conveyed by the rotation of the developing roller 45. The photoreceptor 44 is disposed so as to face the developing roller 45 with a predetermined distance therebetween. The developing roller 45 and the photoreceptor 44 facing each other constitutes a developing nip portion 66. The developer, whose conveyance amount is uniformized by the regulation blade 65, is conveyed to the developing nip portion 66, and receives a predetermined charge. This causes developing operation. The developer that has passed through the developing nip portion 66 is conveyed into the developer 101, separated from the surface of the developing roller 45, and collected in the developer 101.

(Reference Example)

Figure 5:
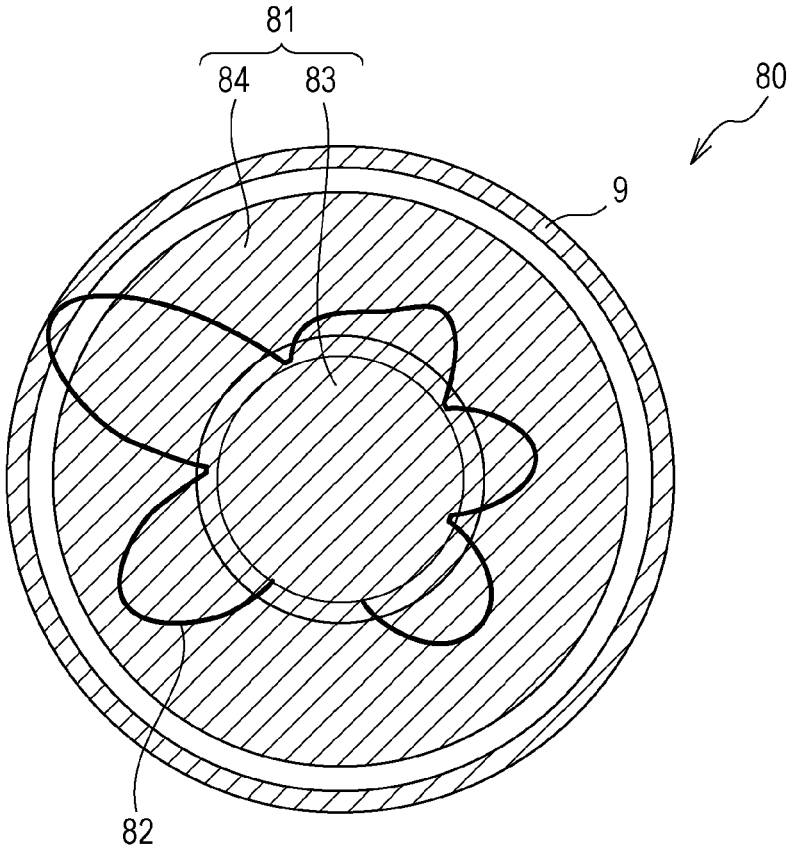
FIG. 5 is a cross-sectional view of a developing roller as a reference example.

Before describing details of the developing roller 45, FIG. 5 illustrates a cross section of a developing roller 80 as a reference example. In the developing roller 80, a magnet roller 81 having a circular outer shape is housed inside the sleeve 9. In FIG. 5, a curve 82 illustrates the magnetic flux density of the magnet roller 81. The curve 82 does not have a shape of visible member, and is thus virtually illustrated by a dotted line. The magnet roller 81 is magnetized so as to have the magnetic flux density indicated by the curve 82. Although the curve 82 is apparently irregular, the curve 82 is intentionally determined in consideration of the developing operation. The magnet roller 81 is a combination of a shaft member 83 and a tubular member 84. The tubular member 84 surrounds the shaft member 83.

Figure 6:
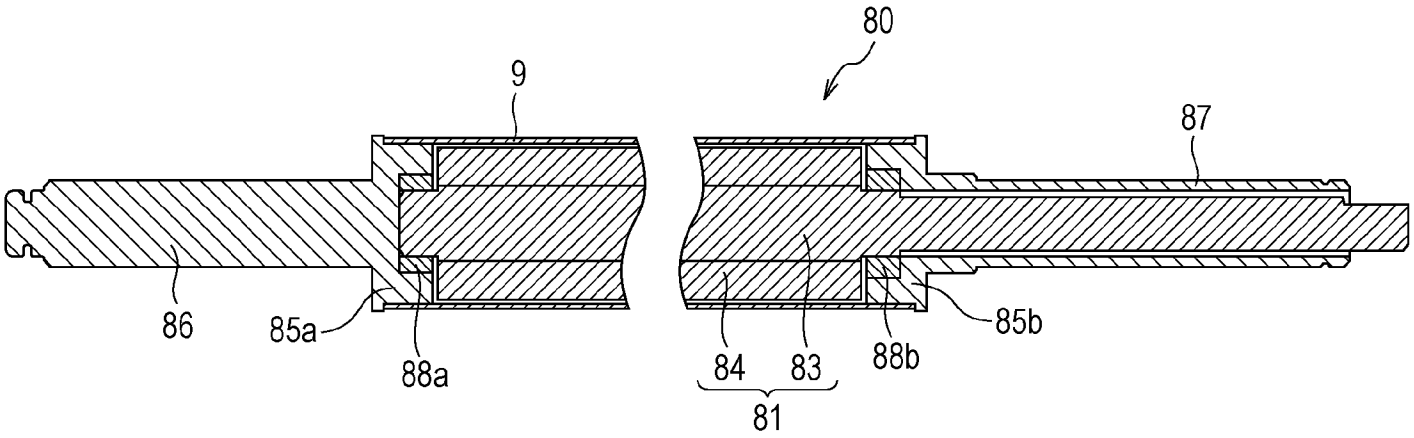
FIG. 6 is a cross-sectional view of the developing roller in a longitudinal direction as the reference example.

FIG. 6 is a cross-sectional view of the developing roller 80 in a longitudinal direction as a reference example. The shaft member 83 is provided in the central portion of the magnet roller 81. The tubular member 84 is disposed so as to surround the shaft member 83. The tubular member 84 is a magnet. The tubular member 84 may be separately molded and combined with the shaft member 83. Alternatively, the tubular member 84 may be formed so as to be attached to the outer peripheral surface of the shaft member 83. The developing roller 80 includes flange parts 85*a* and 85*b*. A bearing 88*a* is attached to one end of the shaft member 83. One end of the shaft member 83 ends inside the flange part 85*a*. The flange part 85*a* is formed integrally with a shaft part 86 extending toward the side opposite to the shaft member 83. The shaft part 86 and the shaft member 83 are coaxial. The flange part 85*b* is formed integrally with a tubular part 87. A part of the shaft member 83 penetrates and extends through the flange part 85*b* and the tubular part 87. A bearing 88*b* is disposed inside the flange part 85*b*. In order to reduce costs, there is proposed a developing roller in which the shaft member 83 and the tubular member 84 are integrally molded.

(Bending)

Figure 7:
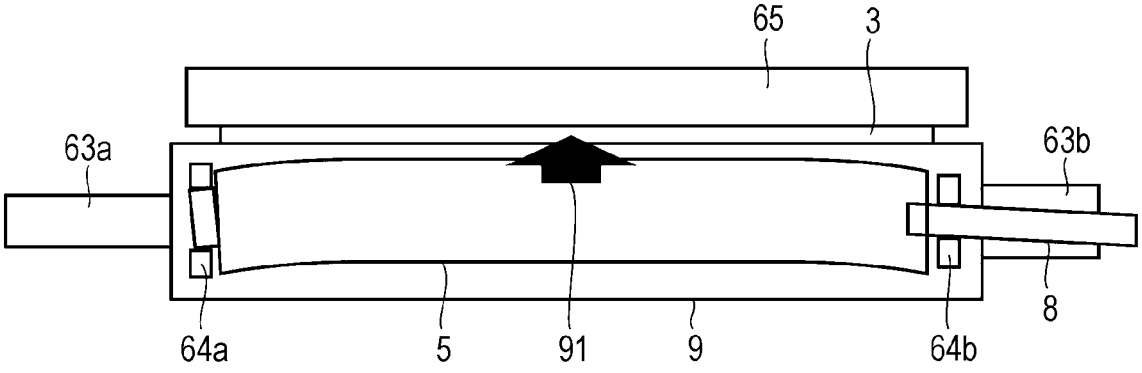
FIG. 7 is an explanatory view of bending that occurs in a magnet roller.

Bending occurring in a magnet roller 5 will be described with reference to FIG. 7. The magnet roller 5 can be deformed as illustrated by an arrow 91 in FIG. 7 by attraction generated by the regulation blade 65 and the attraction generated by developer adsorbed on the outer surface of the developing roller 45. The deformation is bending. The bending of the magnet roller 5 occurs inside the sleeve 9.

(Developing Roller in Image Forming Apparatus in this Embodiment)

Figure 8:
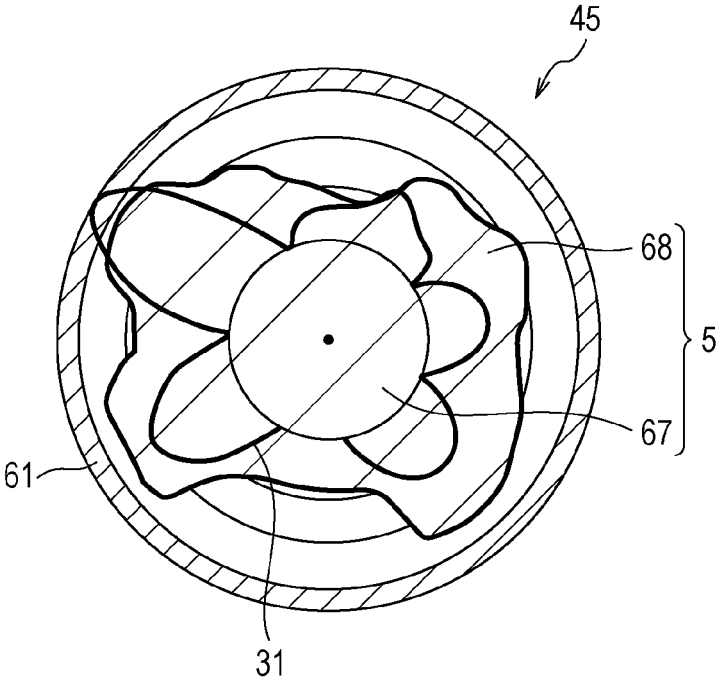
FIG. 8 is a cross-sectional view of the developing roller of the image forming apparatus according to the first embodiment of the invention.

The description will return to the image forming apparatus 801 in this embodiment. FIG. 8 is a cross-sectional view of the developing roller 45 in the developer 101 provided in the image forming apparatus 801. The developing roller 45 includes the sleeve 9 and the magnet roller 5 disposed inside the sleeve 9. The magnet roller 5 includes a shaft part 67 and a magnet part 68. The magnet part 68 is disposed so as to surround the shaft part 67. The shaft part 67 is circular in cross section. The magnet part 68 is irregular in cross section. The cylindrical sleeve 9 surrounds the outside of the magnet part 68. A curve 31 illustrates a magnetic flux density. The magnet part 68 is designed so that the magnetic flux density is in the state illustrated by the curve 31. In order to match the magnetic flux density with the curve 31, the magnet part 68 has an irregular outer shape as illustrated in FIG. 8.

In the case of the developing roller 80 described as a reference example, both the shaft member 83 and the magnet roller 81 have a circular outer shape and thus high rigidity to prevent bending in the developing roller 80. Even when the magnet roller 81 is held by the bearings 88*a* and 88*b* and rotated, large sliding resistance is not generated.

In contrast, the magnet roller 5, in which the magnet part 68 has an irregular outer shape, has low rigidity and a large bending amount. If no measures are taken, the bending causes sliding resistance of the magnet roller 5 to change greatly by the side surface of the magnet roller 5 inclining to rub on a bearing.

In the developing roller 45, in order to perform developing operation, a bias needs to be applied to the surface of the sleeve 9. Unlike a traditional configuration in which two conduction paths are provided on the front and back sides in an axial direction, conduction is performed only on one side in the axial direction in the developing roller 45 in which a metal through shaft is abolished. If no measure is taken, when a bending amount is increased to some extent, contact resistance between a bearing and a metal shaft locally changes at the time of rotation to cause conduction failure.

In order to avoid bending in the developing roller 80, magnet roller 5, and developing roller 45, measures are taken in this embodiment.

Figure 9:
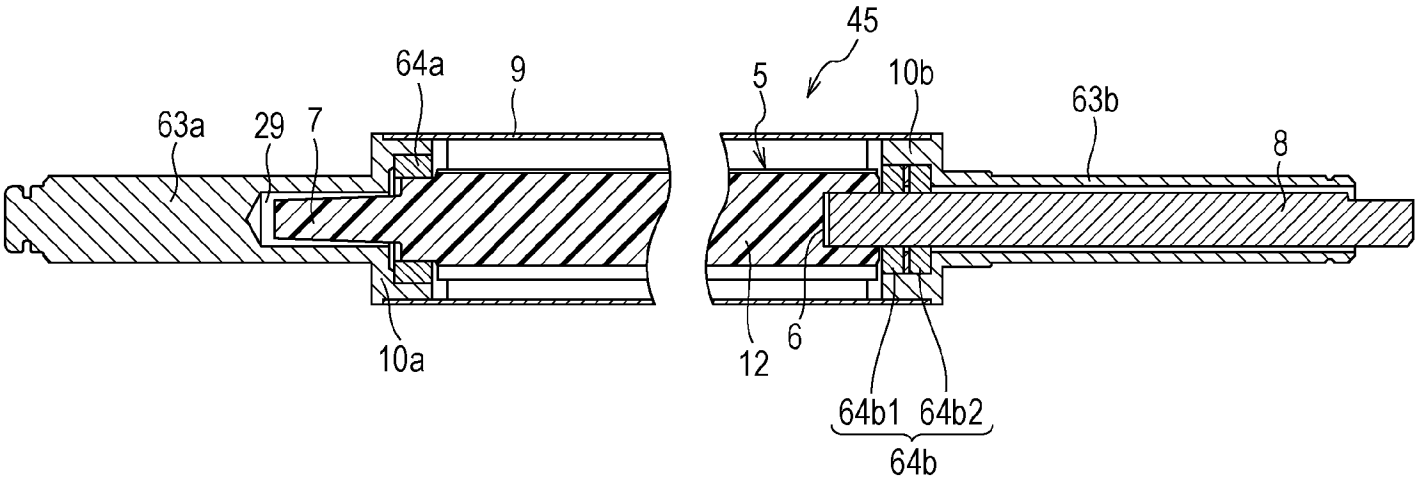
FIG. 9 is a cross-sectional view in the longitudinal direction of the developing roller of the image forming apparatus according to the first embodiment of the invention.

FIG. 9 is a cross-sectional view in a longitudinal direction of the developing roller 45 in this embodiment. As illustrated in FIG. 9, the developing roller 45 includes the magnet roller 5. As described above, the magnet roller 5 may be formed by combining the shaft part 67 and the magnet part 68, or may be formed as an integral object. In the following, the description will be continued on the premise of an example in which the magnet roller 5 is molded as an integral object.

As illustrated in FIG. 9, the magnet roller 5 includes a roll part 12, a shaft part 7, and a shaft member 8. The shaft part 7 protrudes from one end of the roll part 12. The shaft part 7 is circular in cross section, and has a tapered shape in which the diameter decreases toward the tip. The shaft part 7 and the roll part 12 are integrally formed. A recess 6 is provided at the other end of the roll part 12. The shaft parts 63*a* and 63*b* are connected to both ends of the sleeve 9. The shaft part 63*a* includes a storage part 29. The storage part 29 is a recess. The shaft part 7 of the magnet roller 5 is inserted into the storage part 29. An end of the shaft member 8 is inserted into the recess 6 of the roll part 12. The shaft part 63*b* is hollow. The shaft member 8 penetrates the inside of the shaft part 63*b*. The bearing group 64*b* is attached to the shaft part 63*b*. The bearing group 64*b* includes bearings 64*b*1 and 64*b*2. The bearing group 64*b* enables the shaft member 8 to relatively rotate with respect to the shaft part 63*b*. In reality, the shaft member 8 and the roll part 12 remain still, and the sleeve 9 and the shaft parts 63*a* and 63*b* rotate. The right end of the shaft member 8 protrudes from the shaft part 63*b*. In the protruding part, electrical connection is made to the shaft member 8. A bias for development is applied from a high-voltage substrate (not illustrated) to the shaft member 8.

Figure 10:
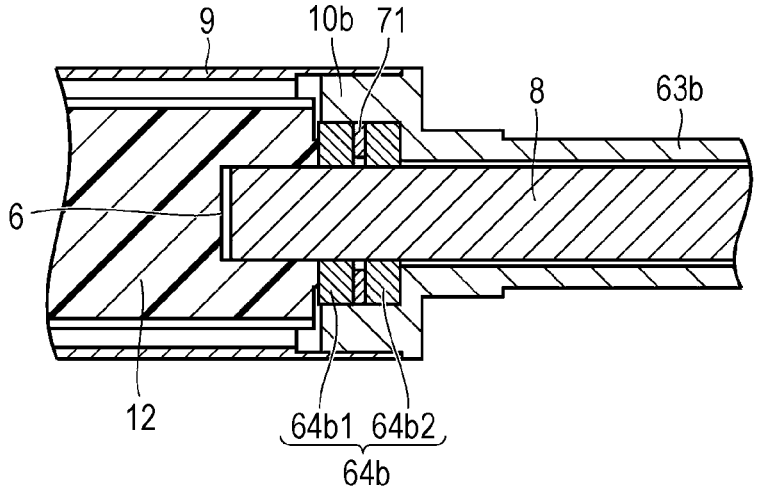
FIG. 10 is an enlarged view of a part in FIG. 9.

FIG. 10 illustrates the enlarged vicinity of the bearing group 64*b* in FIG. 9. Two bearings 64*b*1 and 64*b*2 are disposed in a flange 10*b*. The bearings 64*b*1 and 64*b*2 are pressed into the flange 10*b*. A spacer 71 is interposed between the bearings 64*b*1 and 64*b*2. The spacer 71 causes a fixed distance between the bearings 64*b*1 and 64*b*2. The flange 10*b* has conductivity. The flange 10*b* is pressed into the sleeve 9. The shaft member 8 is conductively coupled to the sleeve 9 via the bearings 64*b*1 and 64*b*2 and the flange 10*b*. Output voltage of a high-voltage substrate is applied to the surface of the sleeve 9 through the conduction path. The magnet roller 5 is bent and deformed by the magnetic attraction applied from the outside.

The image forming apparatus in this embodiment can be summarized as follows.

The image forming apparatus 801 in this embodiment includes the developer 101. The developer 101 includes a developing roller 45. The developing roller 45 includes the magnet roller 5, the cylindrical sleeve 9, a flange 10*a*, the flange 10*b*, and the shaft member 8. The magnet roller 5 includes the roll part 12 having magnetic poles. The sleeve 9 houses the magnet roller 5 inside the sleeve 9 itself. The flange 10*a* is connected to one end of the sleeve 9, and serves as a first flange. The flange 10*b* is connected to the other end of the sleeve 9, and serves as a second flange. The shaft member 8 is connected to the side of the second flange of the magnet roller 5, and serves as a conductive shaft. The developing roller 45 further includes the bearing 64*a*. The bearing 64*a* supports the first flange so that the first flange can rotate relative to the magnet roller, and serves as a first bearing. The developing roller 45 further includes the bearing group 64*b*, that is, the bearings 64*b*1 and 64*b*2. The bearing group 64*b* or the bearings 64*b*1 and 64*b*2 support the second flange so that the second flange can rotate relative to the conductive shaft, and serve as a plurality of second bearings. The plurality of second bearings has conductivity, and is disposed at different positions along the axial direction of the conductive shaft. That is, the bearings 64*b*1 and 64*b*2 have conductivity, and are disposed at different positions along the axial direction of the shaft member 8.

The shaft member 8 is fixedly connected to the magnet roller 5. That is, the magnet roller 5 does not rotate relative to the shaft member 8. Since the shaft member 8 is fixed so as not to rotate with respect to the developer 101, the magnet roller 5 is also fixed so as not to rotate with respect to the developer 101. The surrounding sleeve 9 rotates at the time of development. The shaft member 8 serving as the conductive shaft may be connected to the magnet roller 5 by press fitting. The configuration enables easy and fixed connection.

(Action/Effect)

As illustrated in FIG. 10, the bearings 64*b*1 and 64*b*2 serving as a plurality of second bearings are disposed in the flange 10*b*. Even if the magnet roller 5 is bent, local change in contact resistance between the shaft member 8 and the bearing group 64*b* at the time of rotation can be prevented. As a result, the occurrence of image unevenness due to conduction failure can be prevented.

Although the contact configuration inside the developing roller 45 is described here, the configuration in which the shaft member 8 and the bearing group 64*b* are conducted to each other can be applied not only to a developer of an image forming apparatus but to another device.

Although an example, in which two second bearings are provided, is described, second bearings of other than two may be provided. In the case where only one shaft of the magnet roller 5 is conducted via a bearing, good effect on conductivity can be obtained by providing a plurality of bearings at the conduction part. This is because the shaft and the bearing are combined by clearance fit. A non-conductive state may occur by shaft tilt or local separation between the outer surface of the shaft and the inner surface of the bearing. The non-conductive state may cause conduction failure, but a plurality of bearings can prevent the conduction failure.

That is, even when bending of the magnet roller 5 occurs, conduction failure caused by local change in contact resistance between the bearing and the shaft member 8 serving as a metal shaft at the time of rotation can be inhibited, and influence on an image can be inhibited.

Generally, the inner diameter shape of a bearing cannot be made a perfect circle. The inner surface of an actual bearing has minute irregularities. Since a plurality of second bearings is attached into the flange 10*b* by press fitting, the central axis easily deviates. It is difficult to manufacture the plurality of second bearings such that the second bearings are exactly coaxial after the press fitting. In this embodiment, even when shaft tilt occurs, at least one bearing and the shaft member 8 certainly come in contact with each other by utilizing perfect-circle deviation and coaxial deviation of the plurality of second bearings. As a result, conduction failure can be prevented. In the example in FIG. 10, the spacer 71 provides a slight gap between the bearings 64*b*1 and 64*b*2. Better conduction effects can be obtained by making the distance between the bearings as large as possible.

As illustrated in this embodiment, the spacer 71 may be disposed between a plurality of second bearings. The configuration can widen the distance between bearings. Even when shaft tilt occurs, conduction is easily secured owing to the configuration. The spacer 71 may be, for example, a washer.

Second Embodiment (Configuration)

Figure 11:
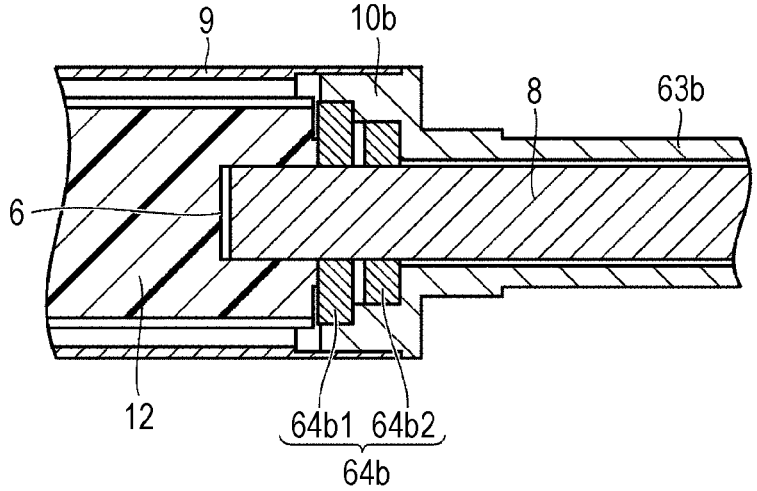
FIG. 11 is a partial cross-sectional view in the longitudinal direction of a developing roller of an image forming apparatus according to a second embodiment of the invention.

An image forming apparatus according to a second embodiment of the invention will be described with reference to FIG. 11. FIG. 11 is a partial cross-sectional view in the longitudinal direction of a developing roller in a developer provided in an image forming apparatus in this embodiment.

Although the basic configuration is similar to that described in the first embodiment with reference to FIG. 10, a spacer is not provided between the bearings 64*b*1 and 64*b*2 in this embodiment. The bearings 64*b*1 and 64*b*2 have different outer diameters. The bearing 64*b*1 has a larger outer diameter than the bearing 64*b*2. Both of the bearings 64*b*1 and 64*b*2 are pressed into the flange 10*b*. In the flange 10*b*, the part that receives the bearing 64*b*2 and the part that receives the bearing 64*b*1 have different inner diameters, and a level difference is provided between the parts. The bearing 64*b*2 having a small outer diameter is first pressed into the flange 10*b*, and then the bearing 64*b*1 having a large outer diameter is pressed into the flange 10*b*. The inner surface of the flange 10*b* has a level difference.

The image forming apparatus in this embodiment can be summarized as follows.

All of the bearing group 64*b* serving as the plurality of second bearings is pressed into the second flange from the side close to the roll part 12 of the second flange. The bearing group 64*b* serving as the plurality of second bearings includes the bearing 64*b*1 and the bearing 64*b*2. The bearing 64*b*1 serves as a large bearing having a first outer diameter. The bearing 64*b*2 serves as a small bearing having a second outer diameter smaller than the first outer diameter. The distance between the bearing 64*b*2 serving as the small bearing and the roll part 12 is longer than the distance between the bearing 64*b*1 serving as the large bearing and the roll part 12.

(Action/Effect)

In this embodiment, effects similar to those described in the first embodiment can be obtained. In this embodiment, since the inner surface of the flange 10*b* has a level difference, the position of the bearing 64*b*1 is fixed, and the bearing 64*b*1 does not approach the bearing 64*b*2 more than necessary. A gap between the bearings 64*b*1 and 64*b*2 is secured without a spacer. The size of the gap between the bearings 64*b*1 and 64*b*2 can be freely set by changing the dimension of the level difference of the flange 10*b*.

As described in the first embodiment, better conduction effects can be obtained by making the gap between the bearings 64*b*1 and 64*b*2 as large as possible.

The roll part 12 has a projection on the end surface on the side of the bearing group 64*b* serving as the plurality of second bearings. The bearing closest to the roll part 12 among the plurality of second bearings, that is, the bearing 64*b*1 protrudes from the second flange to the side of the roll part 12. The projection has an outer diameter smaller than that of the bearing closest to the roll part 12 among the plurality of second bearings that is the bearing 64*b*1. This configuration enables the roll part 12 and the bearing group 64*b* to slide well.

Third Embodiment (Configuration)

Figure 12:
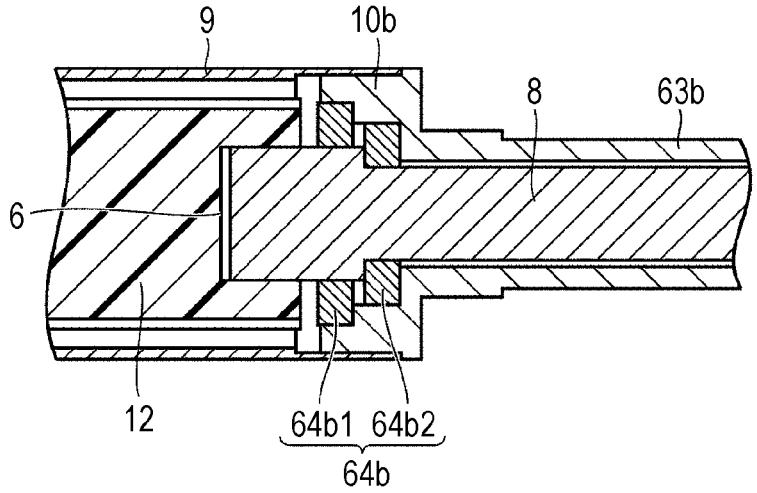
FIG. 12 is a partial cross-sectional view in the longitudinal direction of a developing roller of an image forming apparatus according to a third embodiment of the invention.

An image forming apparatus according to a third embodiment of the invention will be described with reference to FIG. 12. FIG. 12 is a partial cross-sectional view in the longitudinal direction of a developing roller in a developer provided in an image forming apparatus in this embodiment.

Although the basic configuration is similar to that described in the second embodiment with reference to FIG. 11, a level difference is provided on the shaft member 8 itself in this embodiment. The inner surface of the flange 10*b* also has a level difference. The bearing 64*b*1 has a larger outer diameter than the bearing 64*b*2. The bearings 64*b*1 and 64*b*2 have different inner diameters as well as different outer diameters. The bearing 64*b*1 has a larger inner diameter than the bearing 64*b*2.

When the developing roller is assembled, the flange 10*b*, the bearings 64*b*1 and 64*b*2, and the shaft member 8 are preliminarily assembled. The flange 10*a* and the bearing 64*a* are also preliminarily assembled. The sleeve 9 is put on the roll part 12 of the magnet roller 5. The flanges 10*a* and 10*b* are pressed into the sleeve 9.

The image forming apparatus in this embodiment can be summarized as follows. The shaft member 8 serving as the conductive shaft has a level difference in outer diameter. The bearing group 64*b* serving as the plurality of second bearings includes a bearing having a different inner diameter, and is fitted in accordance with the level difference.

(Action/Effect)

In this embodiment as well, effects similar to those described in the second embodiment can be obtained. In this embodiment, the shaft member 8 has a level difference. The axial deviation of the shaft part 7 is regulated by the contact of the level difference of the shaft member 8 and the bearing 64*b*2.

Normally, the magnet roller 5 is fixed so as not to rotate, and the flanges 10*a* and 10*b* and the sleeve 9 rotate. Note, however, that, if the end surface of the roll part 12 of the magnet roller 5 and the end surface of the bearing 64*b*1 are remarkably in contact, the sliding resistance at the part is increased, causing uneven rotation of the magnet roller 5. The uneven rotation leads to a deterioration of image quality. In order to avoid the deterioration of image quality, in consideration of the axial deviation of the shaft part 7, it is necessary to prevent the end surface of the roll part 12 and the end surface of the bearing 64*b*1 from coming in contact with each other, or to minimize the contact area. The end surface shape of the integrally molded roll part 12 coincides with the outer shape of the magnet part 68 in FIG. 8. That is, the end surface of the roll part 12 has an irregular outer shape determined in accordance with a magnetic flux density. In order to prevent uneven rotation, it is possible to provide a small projection that is made to abut and slide on the end surface of the bearing 64*b*1 on the end surface of the roll part 12. Unfortunately, when the end surface of the roll part 12 is irregular as described above, the end surface has no space for providing such a projection. It is significant to prevent the axial deviation by using a level difference of the shaft member 8 as illustrated in FIG. 12.

Fourth Embodiment (Configuration)

Figure 13:
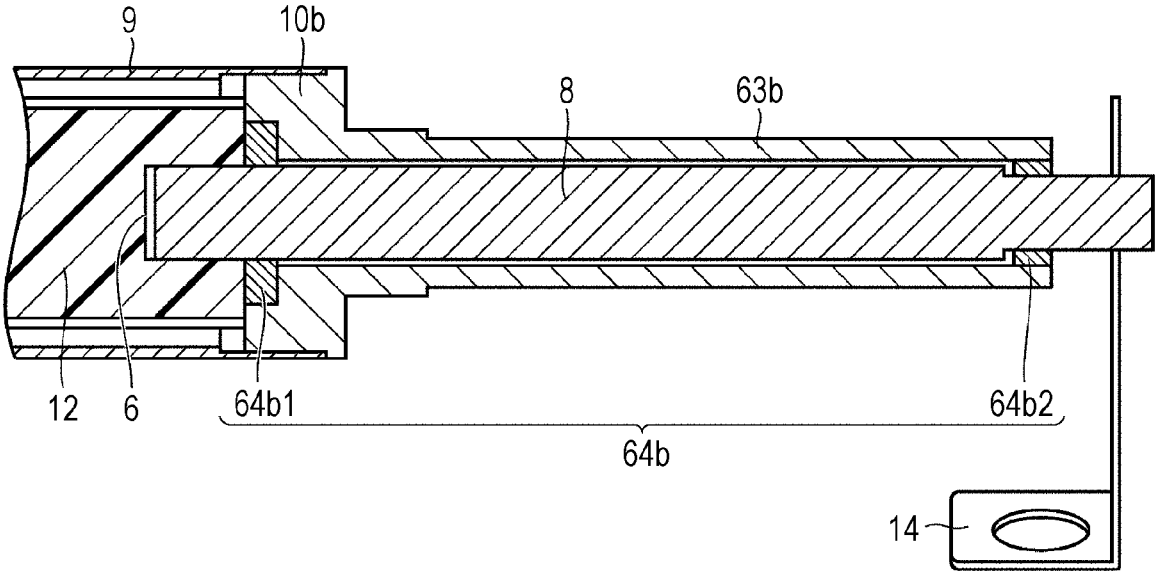
FIG. 13 is a partial cross-sectional view in the longitudinal direction of a developing roller of an image forming apparatus according to a fourth embodiment of the invention.
Figure 14:
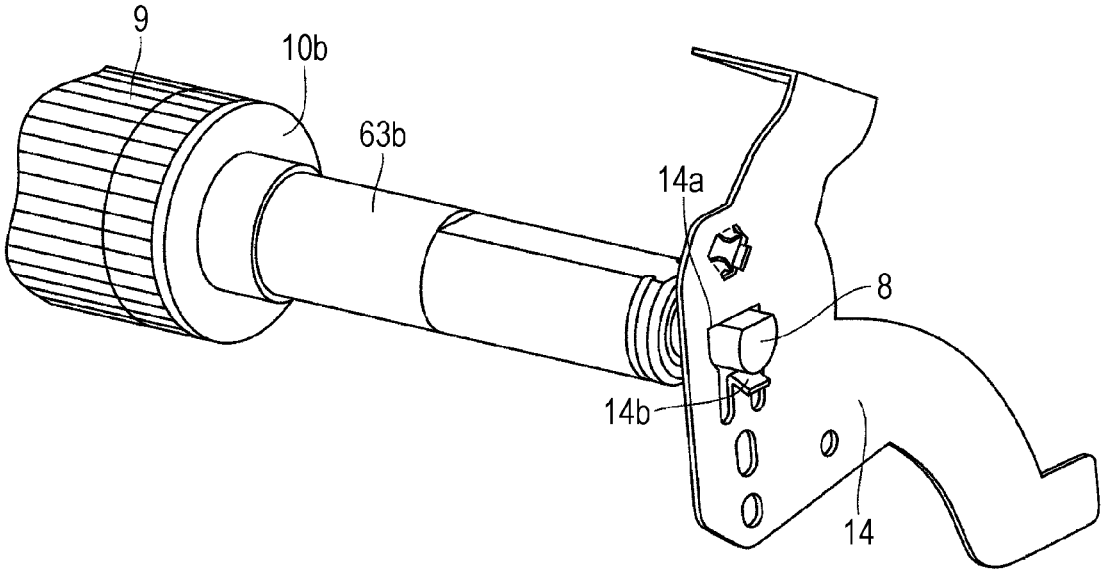
FIG. 14 is a partial perspective view of the vicinity of a developing contact member of the image forming apparatus according to the fourth embodiment of the invention.

An image forming apparatus according to a fourth embodiment of the invention will be described with reference to FIG. 13. FIG. 13 is a partial cross-sectional view in the longitudinal direction of a developing roller in a developer provided in an image forming apparatus in this embodiment. In this embodiment, the two bearings 64*b*1 and 64*b*2 pressed into a member including the flange 10*b* are disposed at positions far away from each other. The bearing 64*b*1 is pressed into the flange 10*b* of the member at the left end in the figure. The bearing 64*b*2 is pressed into the right end of the member in the figure. That is, the bearing 64*b*2 is pressed into the end of the shaft part 63*b*. A developing contact member 14 is connected to the right end of the shaft member 8 in the figure. FIG. 14 illustrates the vicinity of the developing contact member 14. The developing contact member 14 is formed of a metal plate. The end of the shaft member 8 is D-shaped. The developing contact member 14 has an opening 14*a* for receiving the end of the shaft member 8. The D-shaped shaft member 8 is fitted into the opening 14*a*, thereby inhibiting rotation of the shaft member 8. The developing contact member 14 includes a protrusion 14*b* that protrudes toward the opening 14*a*. The protrusion 14*b* is bent. The protrusion 14*b* abuts on the shaft member 8, and presses the shaft member 8 in a certain direction by elasticity. In FIG. 14, the straight part of the D shape of the shaft member 8 faces upward, and the protrusion 14*b* presses the shaft member 8 from below to above. The protrusion 14*b* is a part for securing conduction from the developing contact member 14 to the shaft member 8. The developing contact member 14 is electrically connected to a high-voltage substrate (not illustrated). The developing contact member 14 may be a part of a housing that houses a developing roller. The developing contact member 14 may be a member fixed to the housing that houses a developing roller.

The image forming apparatus in this embodiment can be summarized as follows. The bearing group 64*b* serving as the plurality of second bearings includes the bearing 64*b*1 and the bearing 64*b*2. The bearing 64*b*1 is disposed at one end of the flange 10*b* serving as the second flange. The bearing 64*b*2 is disposed at the other end.

(Action/Effect)

Since the right end of the shaft member 8 in the figure is far from the part where the shaft member 8 is pressed into the recess 6 of the roll part 12, the shaft is easily tilted. In this embodiment, however, the bearing 64*b*2 is disposed near the right end of the shaft member 8 in the figure, and thus the shaft tilt can be corrected by the bearing 64*b*2.

The structure of the developing contact member 14 illustrated in this embodiment is merely one example. The developing contact member 14 may have a structure different from that illustrated here.

The developer 101 may include any of the above-described developing rollers 45. The image forming apparatus 801 may include the developer 101. In the image forming apparatus 801, the developer 101 may be removable. The configuration facilitates maintenance operation for the developer 101. FIG. 2 illustrates the developer 101 detached from the image forming apparatus 801.

A plurality of the above-described embodiments may be appropriately combined and adopted.

The embodiments disclosed here are illustrative in all respects and not restrictive. The scope of the invention is indicated by the claims, and contains all modifications which fall within the meaning and scope equivalent to the claims.

Although embodiments of the present invention have been described and illustrated in detail, the disclosed embodiments are made for purposes of illustration and example only and not limitation. The scope of the present invention should be interpreted by terms of the appended claims.

What is claimed is:

1. A developing roller comprising:

a magnet roller including a roll part with a magnetic pole;

a cylindrical sleeve that houses the magnet roller;

a first flange connected to one end of the cylindrical sleeve;

a conductive second flange connected to another end of the cylindrical sleeve;

a conductive shaft connected to a side of the conductive second flange of the magnet roller;

a first bearing that supports the first flange so that the first flange rotates relative to the magnet roller; and conductive second bearings that support the conductive second flange such that the conductive second flange rotates relative to the conductive shaft, wherein the conductive second bearings are disposed at different positions along an axial direction of the conductive shaft, and the conductive shaft is conductively coupled to the cylindrical sleeve via the conductive second bearings and the conductive second flange.

2. The developing roller according to claim 1, wherein the conductive shaft is connected to the magnet roller by press fitting.

3. The developing roller according to claim 1, a spacer is disposed between the conductive second bearings.

4. The developing roller according to claim 1, wherein all of the conductive second bearings are pressed into the conductive second flange from a side close to the roll part of the conductive second flange, and one of the conductive second bearings has an outer diameter that is larger than an outer diameter of another of the conductive second bearings, where a distance between the one conductive second bearing and the roll part is longer than a distance between the other conductive second bearing and the roll part.

5. The developing roller according to claim 1, wherein the roll part includes a projection on an end surface of a side of the conductive second bearings, one of the conductive second bearings that is closest to the roll part protrudes from the conductive second flange toward a side of the roll part, and the projection has an outer diameter smaller than an outer diameter of the one of the conductive second bearings that is closest to the roll part.

6. The developing roller according to claim 1, wherein an outer diameter of the conductive shaft has a level difference, and the conductive second bearings have different inner diameters, and are fitted in accordance with the level difference.

7. The developing roller according to claim 1, wherein one of the conductive second bearings is disposed at one end of the conductive second flange and another of the conductive second bearings is disposed at another end of the conductive second flange.

8. A developer comprising:

a developing roller, wherein the developing roller comprises:

a magnet roller including a roll part with a magnetic pole;

a cylindrical sleeve that houses the magnet roller;

a first flange connected to one end of the cylindrical sleeve;

a conductive second flange connected to another end of the cylindrical sleeve;

a conductive shaft connected to a side of the conductive second flange of the magnet roller;

a first bearing that supports the first flange so that the first flange rotates relative to the magnet roller; and conductive second bearings that support the conductive second flange such that the conductive second flange rotates relative to the conductive shaft, wherein the conductive second bearings are disposed at different positions along an axial direction of the conductive shaft, and the conductive shaft is conductively coupled to the cylindrical sleeve via the conductive second bearings and the conductive second flange.

9. An image forming apparatus comprising:

a developer that comprises a developing roller, wherein the developing roller comprises:

a magnet roller including a roll part with a magnetic pole;

a cylindrical sleeve that houses the magnet roller;

a first flange connected to one end of the cylindrical sleeve;

a conductive second flange connected to another end of the cylindrical sleeve;

a conductive shaft connected to a side of the conductive second flange of the magnet roller;

a first bearing that supports the first flange so that the first flange rotates relative to the magnet roller; and conductive second bearings that support the conductive second flange such that the conductive second flange rotates relative to the conductive shaft, wherein the conductive second bearings are disposed at different positions along an axial direction of the conductive shaft, and the conductive shaft is conductively coupled to the cylindrical sleeve via the conductive second bearings and the conductive second flange.

10. The image forming apparatus according to claim 9, wherein the developer is removable.

* * * * *